US008474994B2

(12) United States Patent
Campman

(10) Patent No.: US 8,474,994 B2
(45) Date of Patent: Jul. 2, 2013

(54) MULTI PURPOSE VISUAL AND AUDIBLE SIGNALING BATON

(75) Inventor: James P. Campman, Transfer, PA (US)

(73) Assignee: Grace Industries, Inc., Fredonia, PA (US)

( * ) Notice: Subject to any disclaimer, the term of this patent is extended or adjusted under 35 U.S.C. 154(b) by 260 days.

(21) Appl. No.: 13/064,741

(22) Filed: Apr. 13, 2011

(65) Prior Publication Data

US 2012/0262909 A1 Oct. 18, 2012

(51) Int. Cl.
*A45B 3/02* (2006.01)

(52) U.S. Cl.
USPC ..... 362/102; 362/86

(58) Field of Classification Search
USPC ..... 362/102, 184, 158, 186, 190, 191, 362/206, 267, 84
See application file for complete search history.

(56) References Cited

U.S. PATENT DOCUMENTS

| | | | | |
|---|---|---|---|---|
| 6,893,144 | B2 * | 5/2005 | Fan | 362/249.01 |
| 7,293,893 | B2 * | 11/2007 | Kim | 362/205 |
| 8,186,846 | B2 * | 5/2012 | Bertken | 362/217.01 |
| 2011/0103047 | A1 * | 5/2011 | Gross et al. | 362/184 |

* cited by examiner

*Primary Examiner* — Anne Hines
(74) *Attorney, Agent, or Firm* — Daniel K. Dorsey

(57) ABSTRACT

A multi purpose visual and audible signaling baton having applicability to fire scenes, traffic and crowd control, police operations, military procedures, search and rescue operations, and event parking has a whistle and LED assembly. A controller and power assembly controls and powers the baton by directly responding to a plurality of modes including an audible sound generating mode as well as an audio voice button. The baton provides a high intensity colors that illuminate much like a neon tube. The baton can function as a flashlight or strobe light. Also, each light that is selected can be accompanied by a loud 100 dbA whistle, merely by pressing a button. The baton permits a user to select up to ten colors with a capability of five different sounds including verbal commands and the baton, with a radio transmitter, can communicate with a remote radio receiver due to a programmable microprocessor.

20 Claims, 7 Drawing Sheets

MULTI PURPOSE VISUAL AND AUDIBLE SIGNALING BATON

BACKGROUND OF THE INVENTION

Field of the Invention

The present invention relates to a hand held light and sound signaling baton in the field of communication and more particularly to a multi purpose visual and audible signaling baton having light and sound whistle signaling.

CROSS-REFERENCE TO RELATED PATENTS

U.S. Pat. No. 5,865,524, entitled HAND HELD LIGHT WAND FOR VISUAL SIGNALING, to Campman is a resilient and watertight visual signaling light emitting wand that provides a user with a choice of multiple colors by simply turning a ring switch.

U.S. Pat. No. 6,213,623 B1, entitled GLOW AND FLASH BATON, to Campman is a resilient watertight light baton with exterior walls machined to effectively transmit light from an embedded light source, which is easily controlled with one button.

U.S. Pat. No. 6,371,625 B2, entitled ALL SOLID-STATE OMNI DIRECTIONAL LUMINARY AND FLASHLIGHT, to Campman is a hand held laser lens glow and visually signaling baton.

These inventions are hereinafter incorporated by reference therein.

SUMMARY OF THE INVENTION

Accordingly, it is an object of the invention to provide a multi purpose visual and audible signaling baton with a hollow tubular structure having a rear tubular part with a pair of receiving slots and a front tubular part, and a gasket member positioned between the front and rear tubular parts.

Another object of the invention is to provide a plurality of buttons mounted on the rear tubular part, near the gasket member, for switching between a plurality of modes, and the plurality of modes being an on/off mode, an illumination mode, and an audible sound generating mode.

A further object of the invention is to provide a slip resistant plastic vinyl member, abutting the gasket member, for enclosing around the rear tubular part and providing a handgrip area for the hollow tubular structure.

A still further object of the invention is to provide a whistle and LED assembly, positioned in the front tubular part of the hollow tubular structure away from the gasket member, the assembly having a semi-hemispherical concave shaped surface forming an outer opening for providing lighting and sound out the outer opening.

An object of the invention is to provide a bridge bar mounted on the semi-hemispherical concave shaped surface of the whistle and LED assembly to extend across the outer opening, and the bridge bar for providing a holding and securing member in the outer opening of the semi-hemispherical concave shaped surface.

Another object of the invention is to provide a lighting member mounted in the holding and securing member of the bridge bar so as to be positioned in the outer opening of the whistle and LED assembly, and a female electrical plug electrically connected to and extending from the lighting member into the front tubular part of the hollow tubular structure.

It is an object of the invention to provide a tubular shaped front cap, positioned away from the gasket and at a front end of the hollow tubular structure, for surrounding the semi-hemispherical concave shaped surface around the outer opening and securing the whistle and LED assembly at the front tubular part of the tubular structure.

Another object of the invention to provide a controller circuit board having a pair of ear shaped members extending perpendicularly from the controller circuit board for mounting in the rear tubular part with each the ear shaped member aligning and securely mating with each slot of the rear tubular part at a rear distal end of the tubular structure.

A further object of the invention to provide an audio voice button, attached to the controller circuit board between the pair of ear shaped members of the controller circuit board, for activating audio and voice signaling.

It is an object of the invention to provide at least two LEDs, mounted on the controller circuit board near the gasket member and plurality of buttons away from the pair of ear shaped members and the audio voice button, for emitting tubular light in the front tubular part of the tubular structure when activated.

It is an object of the invention to provide a removable rear cap, positioned away from the gasket and at the rear distal end of the tubular structure, for sealing the rear tubular part of the tubular structure around the receiving slots and the securely mated ear shaped members of the controller circuit board, the removable rear cap having an outward protrusion for receiving the audio voice button positioned between the pair of ear shaped members of the controller circuit board.

A still further object of the invention to provide a controller and power assembly mounted on the controller circuit board for controlling and providing power to the multi purpose visual and audible signaling baton, the assembly being electrically connected to the plurality of buttons mounted on the rear tubular part and directly responding to the switching between the plurality of modes and the audible sound generating mode and electrically connected to the audio voice button and the at least two LEDs to respond to the audio voice button and power the at least two LEDs, the controller and power assembly having an electrical connecting member extending into the front tubular part past the at least two LEDs with a male electrical plug attached to the electrical connecting member for electrically mating to the female electrical plug extending from the lighting member and facilitating power and sound to the lighting member at the whistle and LED assembly when activated to function based on the plurality of buttons and the audio voice button.

It is an object of the invention to provide the hollow tubular structure being made of lightweight industrial grade plastic that is waterproof and shock resistant.

It is an object of the invention to provide wherein one of the plurality of buttons being a two-mode type button and activation of the two-mode type button a first time turns the baton on and illuminates one color, a second time turns the baton another color, and activation of the two-mode type button a third time turns the baton off; and another button of the plurality of buttons being a whistle sound button for controlling the audible-sound generating mode of the baton.

It is an object of the invention to provide wherein the at least two LEDs being any color for producing light radiating in the front tubular part with a red light for caution and a green light for all clear.

It is an object of the invention to provide, wherein the slip resistant rubber member, covering the rear tubular part, further functioning as a shock resistant deterrent to protect the controller and power assembly.

It is an object of the invention to provide wherein the controller and power assembly further comprising: a power source for providing power to the controller and power assembly, the power source being mounted to the controller circuit board opposite the controller and power assembly with the controller circuit board positioned there between to compact the controller and power assembly in the rear tubular part.

It is an object of the invention to provide the electrical connecting member further comprising a hollow cylindrical pipe for holding a plurality of wires electrically connecting the controller and power assembly to the male electrical plug, the electrical connecting member being guided through the rear tubular part into the front tubular part with the male electrical plug protruding into to the front tubular part, the ear shaped members of the controller circuit board aligning and snugly mating with the slots of the rear tubular member for securing the controller circuit board in the rear tubular part of the baton and positioning the male electrical plug in the front tubular part past the gasket member.

It is an object of the invention to provide, wherein the piezo whistle sound feature receives a digital command signal and vibrates causing air displacement within the semi-hemispherical concave member for generating sound waves that exceed 100 dbA at 10 feet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Preferred structural embodiments and preferred subcomponents of this invention are disclosed in the accompanying drawings in which.

DESCRIPTION OF THE INVENTION

Figures 1, 2:
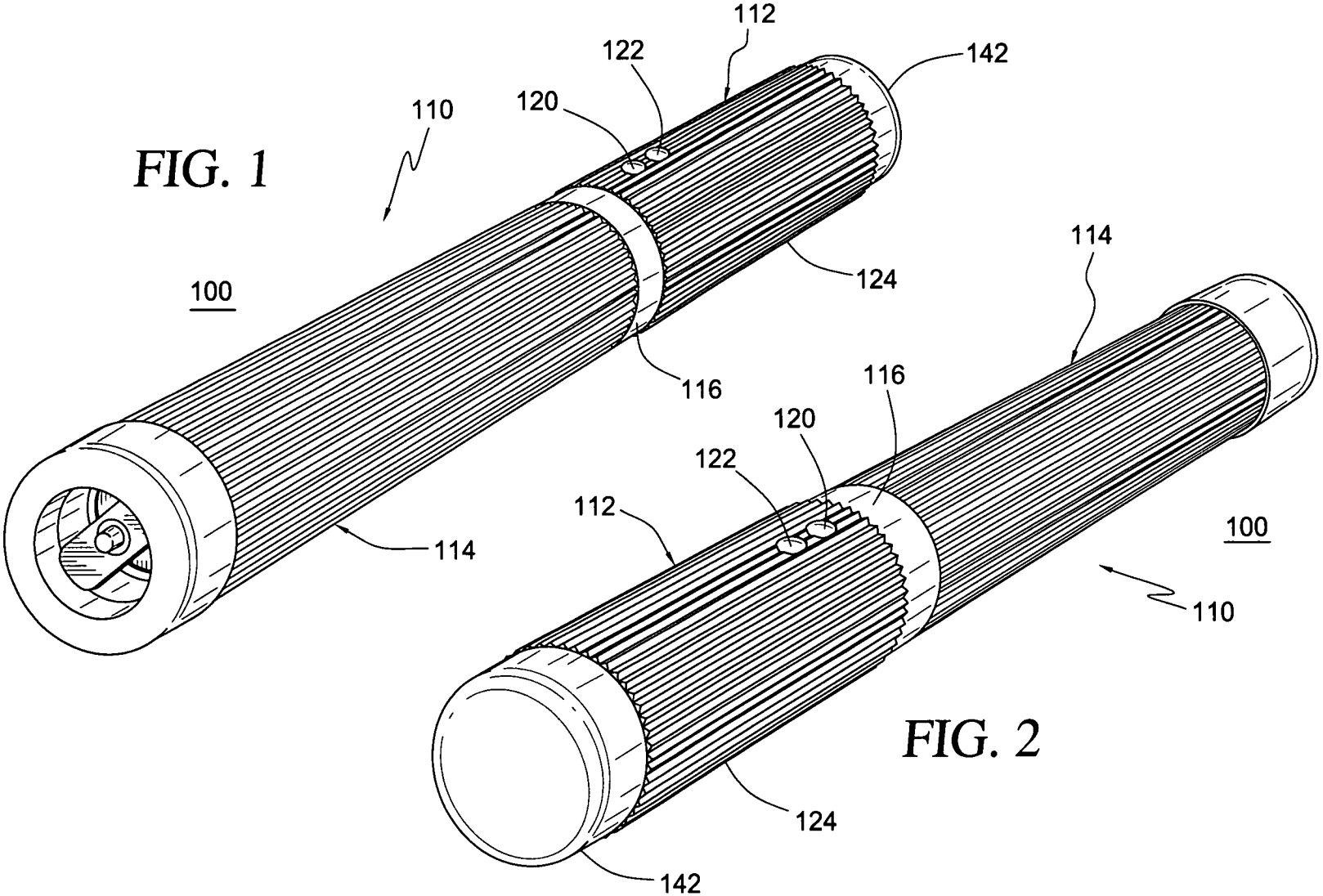
FIG. 1 illustrates a front perspective view of a first embodiment of a multi purpose visual and audible signaling baton in accordance with the present invention.
FIG. 2 illustrates a rear perspective view of the first embodiment of the multi purpose visual and audible signaling baton in accordance with the present invention.

With reference to FIGS. 1 and 2, the figures depict a perspective view of an embodiment of the present invention. As shown, the present invention is illustrated as a multi purpose visual and audible signaling baton, generally indicated by 100. The baton 100 is formed with a hollow tubular structure 110. The hollow tubular structure 110 is one piece about fourteen and a quarter inches long and has a diameter of one and a half inches. The hollow tubular structure 110 is made of industrial grade plastic, which is waterproof, and highly shock resistant, but extremely lightweight. For description purposes, the hollow tubular structure 110 is defined with a rear tubular part 112 and a front tubular part 114. A gasket member 116 is positioned between the rear 112 and front 114 tubular parts.

The baton 100 further includes plurality of buttons 120, 122 mounted on the rear tubular part 112, near the gasket member 116. The plurality of buttons 120, 122 are for switching between a plurality of modes with the plurality of modes being an on/off mode, an illumination mode, and an audible-sound generating mode. More specifically, button 120 is a two-mode type button. The two-mode type button 120 controls the modes on/off and the illumination mode of the baton 100. Pushing the two-mode type button 120 once turns the baton 100 on and illuminates one color, pushing the two-mode type button 120 again turns the baton 100 another color, and pushing the two-mode type button 120 once more, turns the baton 100 off. The second button 122 or whistle sound button controls the audible-sound generating mode of the baton 100.

The baton 100 also has a slip resistant rubber member 124. The slip resistant rubber member 124 encloses around the rear tubular part 112 abutting the gasket member 116 and functions as a handgrip or handgrip area on the rear tubular part 112 of the hollow tubular structure 110 for a user to grasp and hold the baton 100. The slip resistant rubber member 124 additionally provides a sealing or blocking function of any light that may emit from the rear tubular part 112, so any and all of the light emitted is directed to the front tubular part 114 of the baton 100. The slip resistant rubber member 124 nearly completely covers the rear tubular part 112. The two buttons, the two-mode type button 120 and the whistle sound button 122, can either be covered by the slip resistant rubber member 124 with two protrusions for receiving the buttons 120, 122 or the buttons 120, 122 can be exposed with some means to provide a watertight seal around each button.

Figure 3:
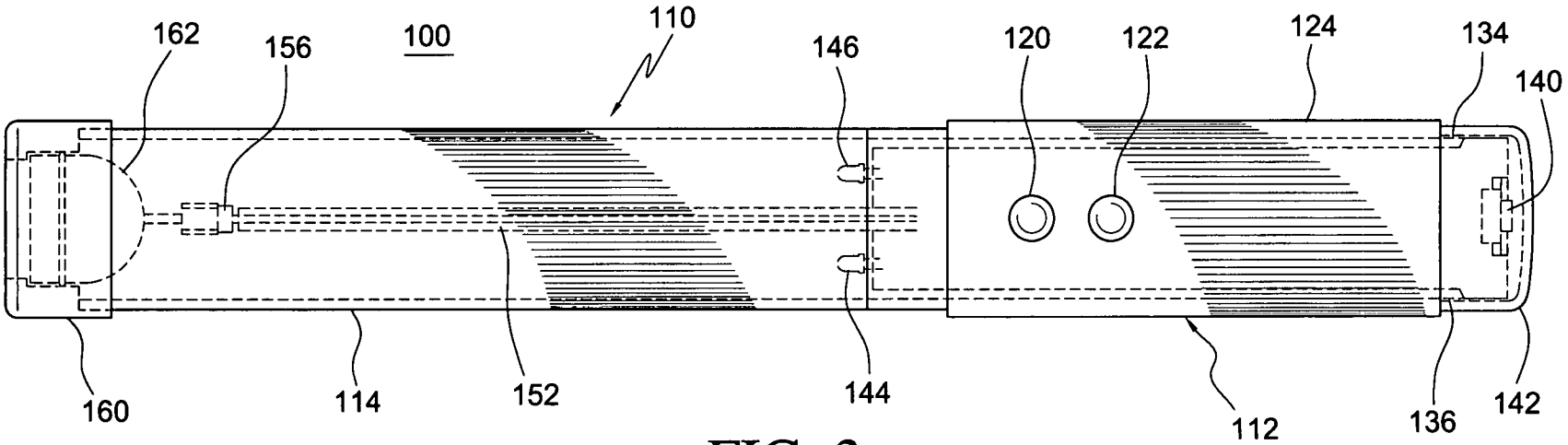
FIG. 3 illustrates a top plan view with a controller and power assembly shown in hatched lines and positioned in place in the multi purpose visual and audible signaling baton accordance with the present invention.
Figure 4:
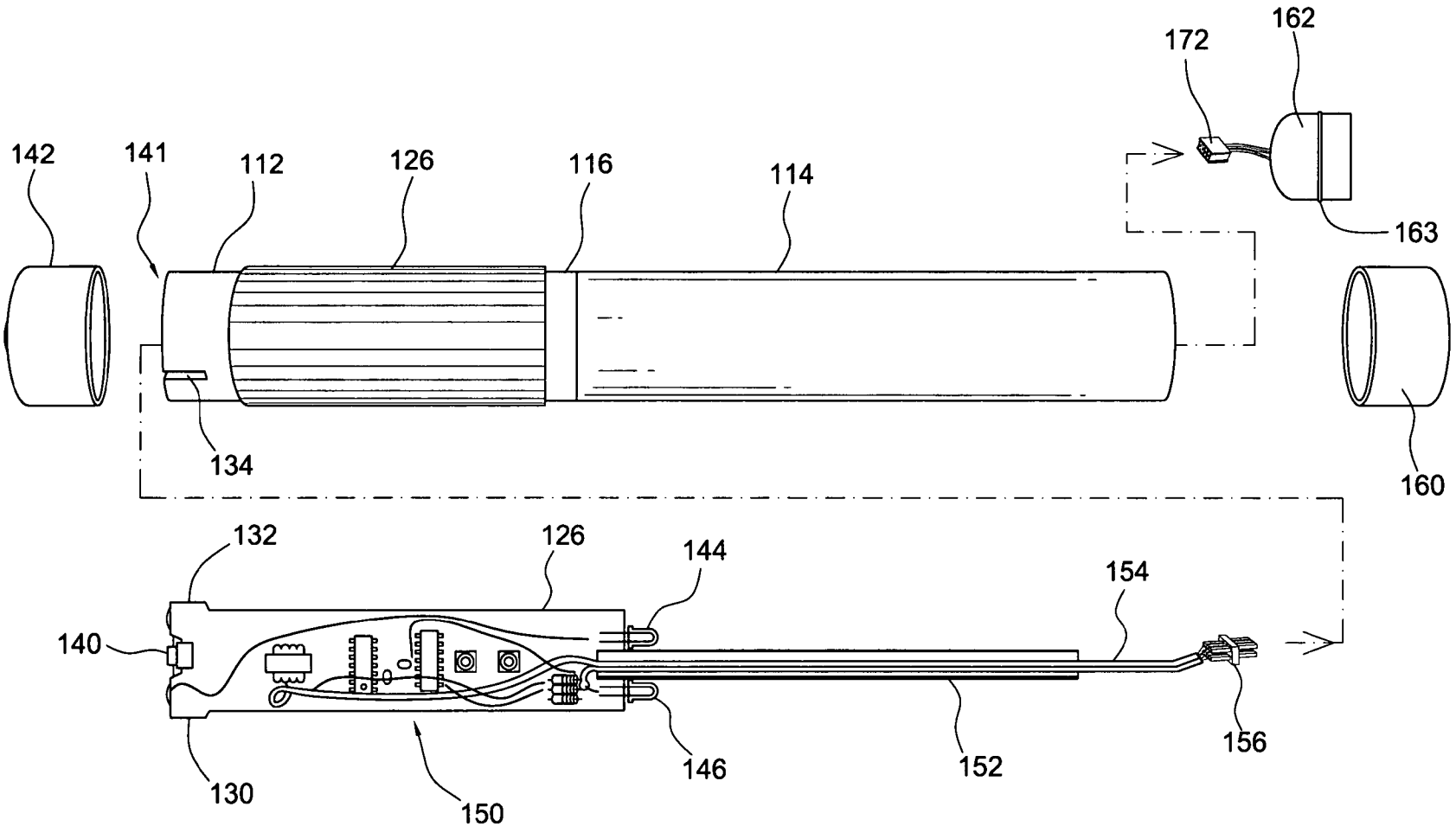
FIG. 4 illustrates an exploded view of the multi purpose visual and audible signaling baton to illustrate the control assembly in accordance with the present invention.

FIGS. 3 and 4 illustrate the baton 100 with a controller circuit board 126 mounted therein. To fixedly mount the controller circuit board 126 into the baton 110, the controller circuit board 126 has a pair of ear shaped members 130, 132 extending perpendicularly from the controller circuit board 126, forming a T-shaped board. These ear shaped members 130, 132 are aligned and then securely slide to fit into a pair of slots 134, 136 that have been cut into a rear distal end 141 of the rear tubular part 112. Additionally, the controller circuit board 126 has a width, away from the ear shaped members 130, 132, that is slightly smaller than a diameter of the rear tubular part 112 so that a snug fit is formed. This snug fit ensures a positioning of the controller circuit board 126 in the rear tubular part 112 and eliminates movement during use of the baton 100.

Positioned between the ear shaped members 130, 132 and attached to the controller circuit board 126 is an audio voice button 140. The audio voice button 140 is for activating audio and voice signaling. A removable rear cap 142 has a diameter that is slightly larger that the rear tubular part 112 and is fitted to the rear tubular part 112 so that the removable rear cap 142 is positioned away from the gasket member 116 at the rear distal end 141 of the hollow tubular structure 110. The removable rear cap 142 is made of a pliable plastic vinyl material. This pliable plastic vinyl material permits the removable rear cap 142 to seal the rear tubular part 112 of the tubular structure 110 around the receiving slots 134, 136 and the securely mated ear shaped members 130, 132 of the controller circuit board 126. Also, the removable rear cap 142 can have an outward protrusion for receiving the audio voice button 140 positioned between the pair of ear shaped members 130, 132 of the controller circuit board 126. Of course, in the preferred embodiment, the pliable plastic vinyl material of the removable rear cap 142 is without a protrusion to permit a user to push on the outer surface of the removable rear cap 142 to activate the audio voice button 140, such as shown in FIG. 3. Finally, as stated, the rear cap 142 is removable for rear access into the hollow tubular structure 110 of the baton 100.

With attention direct to FIG. 4, the controller circuit board 126 further includes at least two LEDs 144, 146 mounted at the proximal end of the controller circuit board 126 that extend into the front tubular part 114 near the gasket member 116 and the plurality of buttons 120, 122 away from the pair of ear shaped members 130, 132 and the audio voice button 140. The at least two LEDs 144, 146 are for emitting tubular light in the front tubular part 114 of the tubular structure 110 when activated. The at least two LEDs 144, 146 can be any color and are used to produce light that radiates in the front tubular part 114. This light can be, for example, a red light for caution or warning and a green light for all clear or safe when the baton 100 is in use and within eyesight of an individual, individuals, or crowds of people.

A controller and power assembly, being generally indicated with numeral 150, is mounted on the controller circuit board 126 and positioned in the rear tubular part 112 of the hollow tubular structure 110. Once, the controller and power assembly 150 is positioned in the rear tubular part 112 the slip resistant rubber member 124, covering the rear tubular part 112, and the pliable plastic vinyl removable rear cap 142 can act and function as shock resistant deterrents to protect the controller and power assembly 150. The controller and power assembly 150 is for controlling and providing power to the multi purpose visual and audible signaling baton 100. The controller and power assembly 150 is electrically connected to the plurality of buttons 120, 122 mounted on the rear tubular part 112 so that the controller and power assembly 150 can directly respond to the switching between the plurality of modes and the audible sound generating mode. The controller and power assembly 150 is also electrically connected to the audio voice button 140 and the at least two LEDs 144, 146 to respond to the audio voice button 140 and power the at least two LEDs 144, 146. The controller and power assembly 150 is shown in schematic representation in FIG. 12 with chip circuitry, switches, resistors, capacitors, and diodes as well as a radio transmitter component particularly set forth with detail electrical connections.

The controller and power assembly 150 further has an electrical connecting member 152 extending from the controller circuit board 126 into the front tubular part 114 past the at least two LEDs 144, 146. The electrical connecting member 152 is a hollow cylindrical hose or pipe that carries or holds a plurality of wires 154 and electrically connects the controller and power assembly 150 to a male electrical plug 156. The electrical connecting member 152 acts as a guide for the plurality of wires 154 when the controller circuit board 126 is inserted into the rear tubular part 112 with the male electrical plug 156 entering first and being guided through the rear tubular part 112 into the front tubular part 114. Once the male electrical plug 156 protrudes into to the front tubular part 114, the ear shaped members 130, 132 of the controller circuit board 126 are aligned and snugly mated with the slots 134, 136. Thus, securing the controller circuit board 126 in the rear tubular part 112 of the baton 100 and positioning the male electrical plug 156 in the front tubular part 114 past the gasket member 116.

With continuing reference to FIGS. 3 and 4, a front cap 160 is shown. The front cap 160 is similar in shape to the removable rear cap 142 that being a round tubular shape, with the front cap 160 having a diameter slightly larger than the front tubular part 114 and being approximately one and three quarter inches in diameter. The front cap 160 is basically open on both ends to be like a pipe or tube and is made of a pliable plastic vinyl material. The front tubular cap 160 snugly and securely fits to the proximal end of the hollow tubular structure 110 on the front tubular part 114 so as to be positioned away from the gasket member 116. Prior to cementing the front cap 160 to the front end of the hollow tubular structure 110, a semi-hemispherical concave shaped surface member 162 is inserted into the front tubular part 114. The semi-hemispherical concave member 162 has a diameter slightly smaller than that of the front tubular part 114 and a rubber seal 163 around the diameter so that a snug and secure fit is formed when mounted into the front tubular part 114 of the hollow tubular structure 110.

Figure 6:
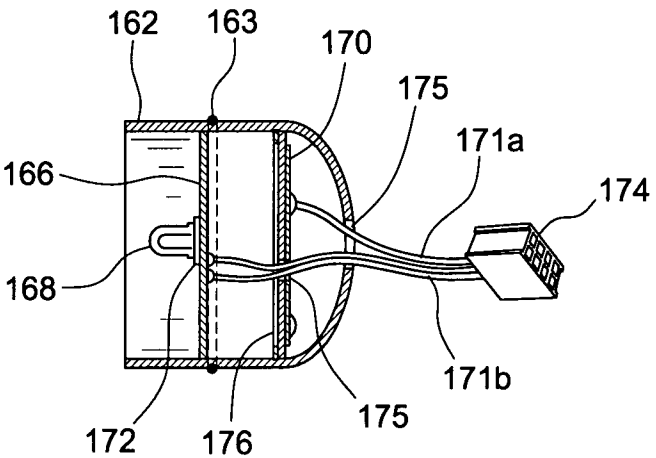
FIG. 6 illustrates a cut-away view of the front cap illustrated in FIG. 5 in accordance with the present invention.
Figure 5:
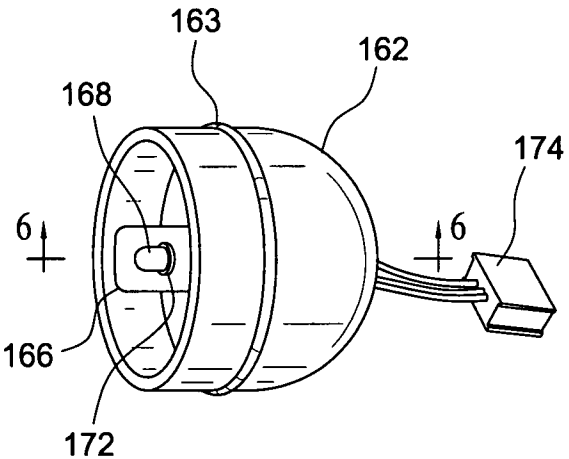
FIG. 5 illustrates a perspective view of a front cap utilized in the first embodiment of the multi purpose visual and audible signaling baton in accordance with the present invention.

FIGS. 5 and 6 illustrate the semi-hemispherical concave member 162. The semi-hemispherical concave member 162 forms an outer opening for providing means for lighting and sound to exit during use of the baton 100. In the outer opening, a whistle and LED assembly 164 is positioned. The whistle and LED assembly 164 includes a bridge bar 166, which is mounted across the diameter of the semi-hemispherical concave shaped surface 162. The bridge bar 166 includes a lighting member or LED 168 and, beneath the bridge bar 166, a piezo whistle and sound fixture 170. The bridge bar 166 and piezo whistle and sound fixture 170 are exposed in the outer opening, yet appear countersunk and protected by the front tubular cap 160 with the front tubular cap 160 acting as an end of a flashlight. This exposure or positioning permits the LED 168 to be turned on and function as a flashlight due to the intensity of the light and the inner sides of the front tubular cap 160 guiding the light to form a beam. Alternatively, the LED 168 can be programmed to be a strobe light for different kinds of illumination. The piezo whistle and sound fixture 170 is a loud (100 dBA) whistle. Electrically connecting each of these in the whistle and LED assembly 164 is a plurality of wires 171*a*, 171*b* that electrically connect to a female electrical plug 174. The female electrical plug 174 of the whistle and LED assembly 164 electrically mates with the male electrical plug 156 of the controller and power assembly 150 by extending from the the whistle and LED assembly 164 into the front tubular part 114 of the hollow tubular structure 110.

Figure 12:
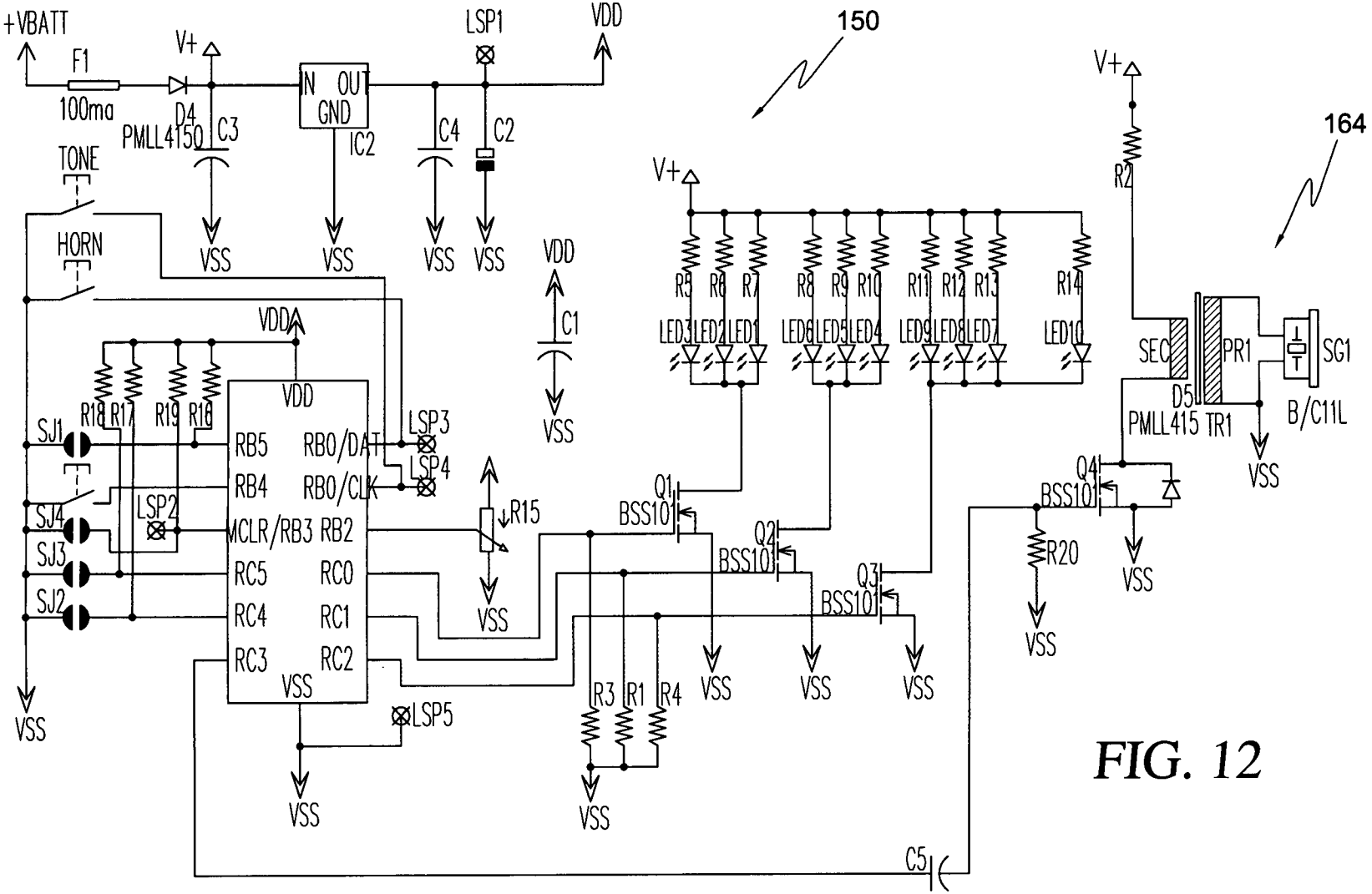
FIG. 12 illustrates a schematic circuit diagram of the multi purpose visual and audible signaling baton for each of the embodiments in accordance with present invention.

Thus, the controller and power assembly 150, by way of the buttons 120, 122, and 140, provides functional signals to control and power the whistle and LED assembly 164 with FIG. 12 illustrating the electrical schematic of both assemblies 150, 164.

With respect to the piezo whistle sound feature 170, the principle operation is an application or generation of a tone frequency or digital command signal to the piezo whistle sound feature 170, which causes the piezo whistle sound feature 170 to vibrate. This vibration in turn causes air displacement within the semi-hemispherical concave member 162 and generates the sound waves that exceed 100 dbA at 10 feet. The fact that high-level sound waves are produced in a small transducer or the piezo whistle sound feature 170 makes it an excellent attention getting device for the baton 100.

Figure 7:
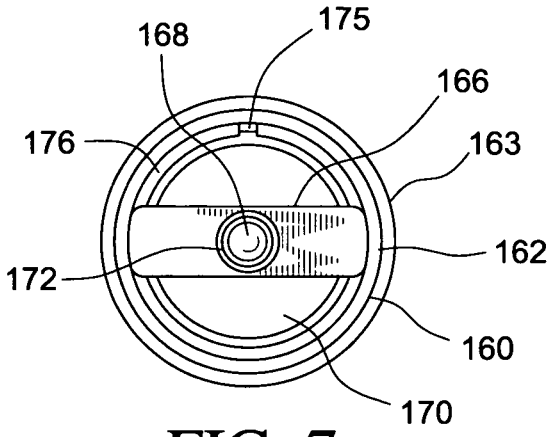
FIG. 7 illustrates a front view of the front cap utilized with one light in the first embodiment in accordance with the present invention.
Figure 8:
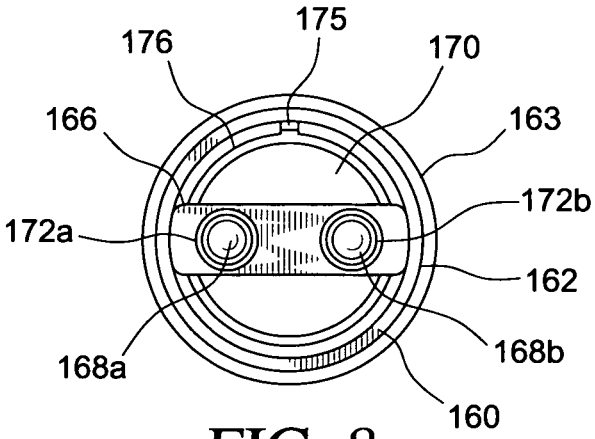
FIG. 8 illustrates a front view of a second front cap utilized with two lights in a second embodiment in accordance with the present invention.
Figure 9:
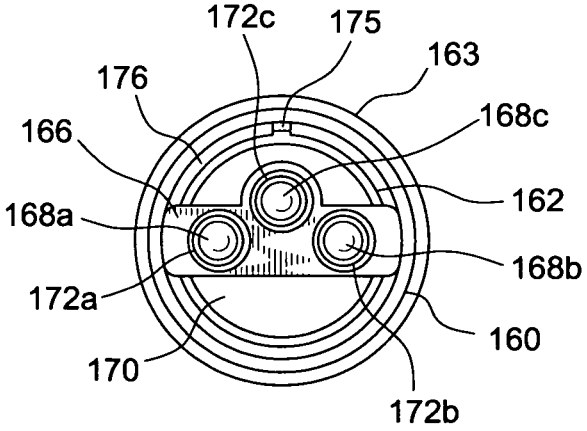
FIG. 9 illustrates a front view of a third front cap utilized with three lights in a third embodiment in accordance with the present invention.

With reference to FIG. 6 and as shown in FIGS. 7, 8, and 9, the bridge bar 166 functions as a holding and securing member in the outer opening of the semi-hemispherical concave shaped surface 162. As part of this function, LED 168 is mounted and secured in position by a LED rubber seal 172 that surrounds the LED 168. As shown in FIGS. 7, 8, and 9, any number of LEDs can be used such as LEDs 168*a*, 168*b*, and 168*c* illustrate, with each being surrounded by LED rubber seals 172*a*, 172*b*, 172*c*. To insure the wires 171 b extend to the LED 168, as shown in FIG. 6, a slot 175 is provided in the piezo whistle sound fixture 170 and, then at the base of the semi-hemispherical concave member 162, a wire hole is provided so the wires 171*a*, 171*b* can proceed to connect to the female plug 174. To secure the piezo whistle sound feature 170 in position, a snap ring 176 is provided between the piezo whistle sound feature 170 and the bridge bar 166. Accordingly, as illustrated by FIGS. 7, 8, and 9, the bridge bar 166 can accommodate up to three separate LEDs 168*a*, 168*b*, 168*c*. This permits a color change when looking directly into the front cap 160 and these LEDs can also operate as a flashlight.

Figure 10:
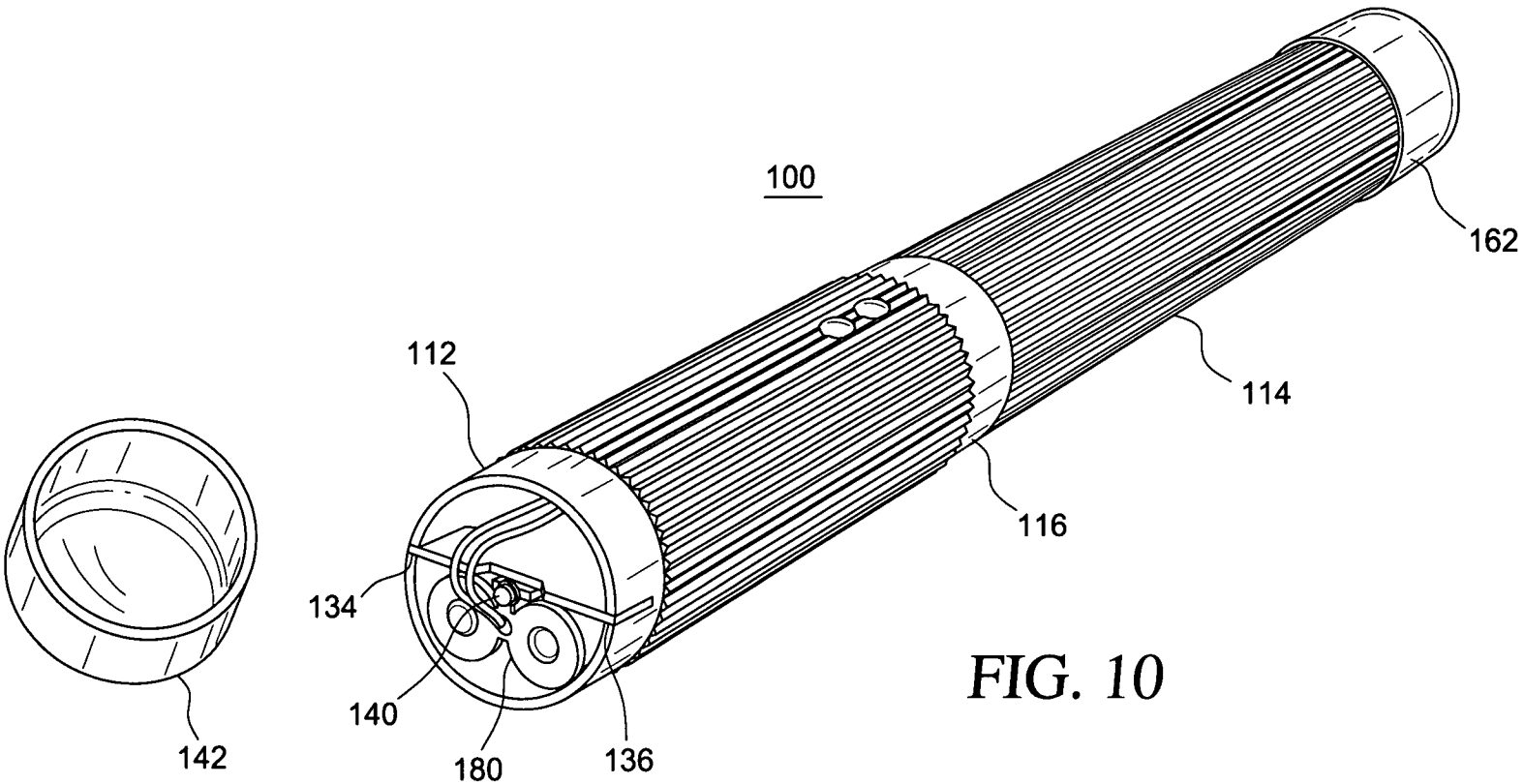
FIG. 10 illustrates the perspective rear view of the multi purpose visual and audible signaling baton with a rear cap removed to show a removable power supply in accordance with present invention.

FIG. 10 shows the rear cap 142 removed to illustrate the positioning of a power source or battery fixture 180 that provides power to the controller and power assembly 150. The battery fixture 180 is conveniently mounted to the bottom of the controller circuit board 126 to make the entire controller and power assembly 150 compact in the rear tubular part 112. In the embodiments shown, including a second embodiment in FIG. 11, the baton 100 is powered by four AA sized alkaline batteries or four rechargeable AA size batteries that make up the battery fixture 180. Additionally, as shown in FIG. 10, the slots 134, 136 with the ear shaped members 130, 132 mated thereto are also visible.

In the first embodiment shown in FIG. 1, the multi purpose visual and audible signal baton 100 is an illuminated, attention getting, red glow baton that is housed in the brilliant red hollow tubular structure 110. In this embodiment, the baton 100 is a single color red.

Figure 11:
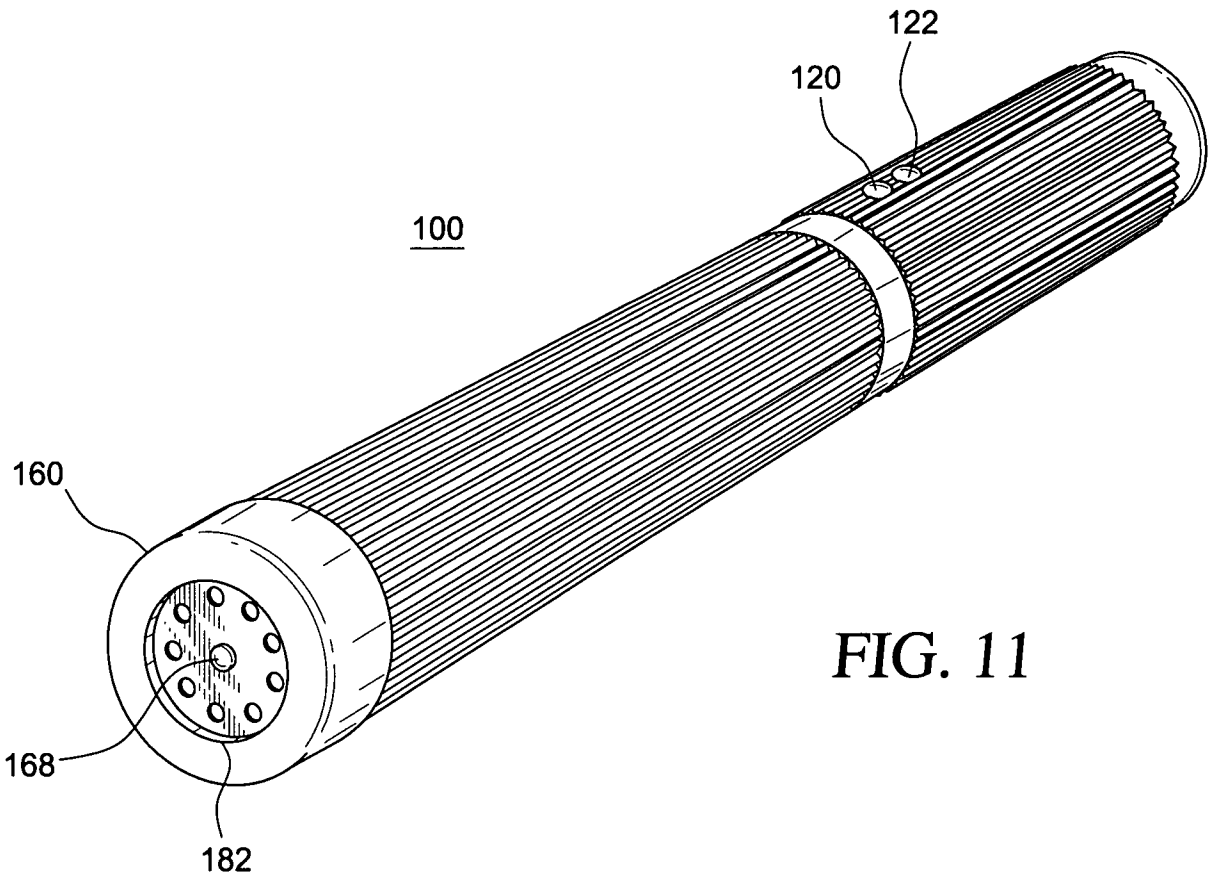
FIG. 11 illustrates a perspective view of another embodiment of the multi purpose visual and audible signaling baton with a front cap having a sound hole configuration in accordance with present invention.

In the second embodiment shown in FIG. 11, the baton 100 features the same loud whistle and LED assembly 164 as in the first embodiment, but also includes a two-color type of visual signaling. The baton 100, shown in FIG. 11, is housed in the hollow tubular structure 110, but rather than being red, it is green. The baton 100, in the second embodiment, will glow red with an initial press of the two-mode button 120 to control the light to indicating caution for those individuals in eyesight of the baton 100.

By pressing the two-mode button 120 again, the controller and power assembly 150 will turn the light of the baton 100 to green for indicating all is clear and safe to those individuals in eyesight range of the baton 100. The second button or whistle and sound button 122 will activate a loud audible whistle. This loud audible whistle is only activated when the whistle and sound button 120 is depressed. And, as shown in FIG. 11, the front cap 160 includes a sound member 182 with a plurality of holes for facilitating audible signaling through the holes from the piezo whistle sound feature 170.

With further reference to FIG. 12, the controller circuit board 126 with the controller and power assembly 150 includes a microprocessor and a radio transmitter with the microchip part number PIC16F526. The radio transmitter is capable of sending radio signals and operates in license free radio bands. This license free radio may be operated independent of other features in the baton 100, such as light or sound. Additionally, the piezo whistle sound feature 170, as part the whistle and LED assembly 164, can generate sound pressures in excess of 100 dbA at 10 feet. The piezo whistle sound feature 170 is independent from the light of the LEDs and may be activated with any of the LEDs of the baton 100 either on or off.

Accordingly, the multi purpose visual and audible signaling baton 100 provides a choice of high intensity colors that cause the baton 100 to illuminate much like a neon tube. Also, each of the color lights that are selected can be accompanied by a loud 100 dbA whistle, merely by pressing the whistle sound button 122. This type of audio sound or even a voice sound can be changed by pressing the audio voice button 140 at the rear cap 142 of the baton 100. The baton 100, when in use, permits a user to select up to ten colors with the capability of five different sounds including verbal spoken commands and it is possible that the baton 100, with the radio transmitter, can communicate with a remote radio receiver. Thus, the baton 100 has applicability to fire scenes, traffic and crowd control, police operations, military procedures, search and rescue operations, and event parking.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

The invention claimed is:

1. A multi purpose visual and audible signaling baton, comprising:

a hollow tubular structure having a rear tubular part with a pair of receiving slots and a front tubular part, and a gasket member positioned between said front and rear tubular parts;

a plurality of buttons mounted on said rear tubular part, near said gasket member, for switching between a plurality of modes, and said plurality of modes being an on/off mode, an illumination mode, and an audible sound generating mode;

a slip resistant plastic vinyl member, abutting the gasket member, for enclosing around said rear tubular part and providing a handgrip area for said hollow tubular structure;

a whistle and LED assembly, positioned in the front tubular part of said hollow tubular structure away from said gasket member, said assembly having a semi-hemispherical concave shaped surface forming an outer opening for providing lighting and sound out the outer opening;

a bridge bar mounted on said semi-hemispherical concave shaped surface of said whistle and LED assembly to extend across the outer opening, and said bridge bar for providing a holding and securing member in the outer opening of said semi-hemispherical concave shaped surface;

a lighting member mounted in said holding and securing member of said bridge bar so as to be positioned in the outer opening of said whistle and LED assembly, and a female electrical plug electrically connected to and extending from said lighting member into said front tubular part of said hollow tubular structure;

a tubular shaped front cap, positioned away from the gasket and at a front end of said hollow tubular structure, for surrounding said semi-hemispherical concave shaped surface around the outer opening and securing said whistle and LED assembly at said front tubular part of said tubular structure;

a controller circuit board having a pair of ear shaped members extending perpendicularly from said controller circuit board for mounting in said rear tubular part with each said ear shaped member aligning and securely mating with each said slot of said rear tubular part at a rear distal end of said tubular structure;

an audio voice button, attached to said controller circuit board between said pair of ear shaped members of said controller circuit board, for activating audio and voice signaling;

at least two LEDs, mounted on said controller circuit board near said gasket member and plurality of buttons away from said pair of ear shaped members and said audio voice button, for emitting tubular light in said front tubular part of said tubular structure when activated;

a removable rear cap, positioned away from said gasket and at the rear distal end of said tubular structure, for sealing said rear tubular part of said tubular structure around said receiving slots and said securely mated ear shaped members of said controller circuit board, said removable rear cap having an outward protrusion for receiving said audio voice button positioned between said pair of ear shaped members of said controller circuit board; and a controller and power assembly mounted on said controller circuit board for controlling and providing power to said multi purpose visual and audible signaling baton, said assembly being electrically connected to said plurality of buttons mounted on said rear tubular part and directly responding to the switching between said plurality of modes and the audible sound generating mode and electrically connected to said audio voice button and said at least two LEDs to respond to said audio voice button and power said at least two LEDs, said controller and power assembly having an electrical connecting member extending into the front tubular part past said at least two LEDs with a male electrical plug attached to said electrical connecting member for electrically mating to said female electrical plug extending from the lighting member and facilitating power and sound to said lighting member at said whistle and LED assembly when activated to function based on said plurality of buttons and said audio voice button.

2. The multi purpose visual and audible signaling baton of claim 1, wherein said hollow tubular structure being made of lightweight industrial grade plastic that is waterproof and shock resistant.

3. The multi purpose visual and audible signaling baton of claim 1, wherein one of said plurality of buttons being a two-mode type button and activation of said two-mode type button a first time turns said baton on and illuminates one color, a second time turns said baton another color, and activation of said two-mode type button a third time turns said baton off; and another button of said plurality of buttons being a whistle sound button for controlling the audible-sound generating mode of said baton.

4. The multi purpose visual and audible signaling baton of claim 1, wherein said at least two LEDs being any color for producing light radiating in said front tubular part with a red light for caution and a green light for all clear.

5. The multi purpose visual and audible signaling baton of claim 1, wherein said slip resistant rubber member, covering said rear tubular part, further functioning as a shock resistant deterrent to protect said controller and power assembly.

6. The multi purpose visual and audible signaling baton of claim 1, wherein said controller and power assembly further comprising:

a power source for providing power to said controller and power assembly, said power source being mounted to said controller circuit board opposite said controller and power assembly with said controller circuit board positioned there between to compact said controller and power assembly in said rear tubular part.

7. The multi purpose visual and audible signaling baton of claim 1, wherein said electrical connecting member further comprising:

a hollow cylindrical pipe for holding a plurality of wires electrically connecting said controller and power assembly to said male electrical plug, said electrical connecting member being guided through said rear tubular part into said front tubular part with said male electrical plug protruding into to said front tubular part, said ear shaped members of said controller circuit board aligning and snugly mating with the slots of said rear tubular member for securing said controller circuit board in said rear tubular part of said baton and positioning said male electrical plug in said front tubular part past said gasket member.

8. The multi purpose visual and audible signaling baton of claim 1, wherein said piezo whistle sound feature receives a digital command signal and vibrates causing air displacement within said semi-hemispherical concave member for generating sound waves that exceed 100 dbA at 10 feet.

9. A multi purpose visual and audible signaling baton, comprising a one piece hollow tubular structure having a rear tubular part and a front tubular part, and said rear tubular part having a pair of slots cut into a rear distal end of said rear tubular part;

a gasket member positioned between said rear tubular part and said front tubular part on said one piece hollow tubular structure;

a plurality of buttons mounted on said rear tubular part of said one piece hollow tubular structure, near said gasket member, for switching between a plurality of modes with said modes being defined as an on/off mode, an illumination mode, and an audible-sound generating mode;

a slip resistant rubber member, nearly enclosing around said rear tubular part and abutting the gasket member, for functioning as a handgrip and blocking light in said rear tubular part by directing the light to said front tubular part of said baton, with said mounted plurality of buttons protruding through said slip resistant rubber member for readily access;

a controller circuit board fixedly mounted in said rear tubular part of said hollow tubular structure, said controller circuit board having a pair of ear shaped members extending perpendicularly to form a T-shaped board, said ear shaped members being aligned and securely sliding into said pair of slots at the rear distal end of said rear tubular part to position said controller circuit board in said rear tubular part of said hollow tubular structure;

an audio voice button, positioned between said ear shaped members and attached to said controller circuit board, for activating audio and voice signaling;

at least two LEDs, mounted said controller circuit board near said gasket member and said plurality of buttons away from said pair of ear shaped members and said audio voice button, for emitting tubular light in said front tubular part of the tubular structure when activated;

a controller and power assembly, mounted on said controller circuit board and positioned in said rear tubular part of said hollow tubular structure, for controlling and providing power to said multi purpose visual and audible signaling baton, said controller and power assembly being electrically connected to said plurality of buttons mounted on said rear tubular part for directly responding to the switching between the plurality of modes and the audible sound generating mode, and electrically connected to said audio voice button and said at least two LEDs for responding to said audio voice button and powering said at least two LEDs;

a semi-hemispherical concave shaped surface member inserted into said front tubular part away from said gasket member, said semi-hemispherical concave member having a diameter slightly smaller than that of said front tubular part and forming an outer opening, a whistle and LED assembly being positioned in the outer opening of said semi-hemispherical concave shaped surface member, said whistle and LED assembly including a bridge bar mounted across said semi-hemispherical concave shaped surface, and said bridge bar having a lighting member and a piezo whistle and sound fixture positioned below said bridge bar in the outer opening, and a female electrical plug extending into said front tubular part towards said gasket member and away from the outer opening, said female electrical plug having a plurality of wires electrically connected to said whistle and LED assembly; and an electrical connecting member having a plurality of wires electrically connected to said controller and power assembly and extending from said controller circuit board into said front tubular part past said at least two LEDs and a male electrical plug connected to said plurality of wires, said male electrical plug electrically mating with said female electrical plug of said whistle and LED assembly to assist said the controller and power assembly for providing control and power to said whistle and LED assembly.

10. The multi purpose visual and audible signaling baton of claim 9, wherein said hollow tubular structure being made of lightweight industrial grade plastic that is waterproof and shock resistant.

11. The multi purpose visual and audible signaling baton of claim 9, wherein one of said plurality of buttons being a two-mode type button and activation of said two-mode type button a first time turns said baton on and illuminates one color, a second time turns said baton another color, and activation of said two-mode type button a third time turns said baton off; and another button of said plurality of buttons being a whistle sound button for controlling the audible-sound generating mode of said baton.

12. The multi purpose visual and audible signaling baton of claim 9, wherein said at least two LEDs being any color for producing light radiating in said front tubular part with a red light for caution and a green light for all clear.

13. The multi purpose visual and audible signaling baton of claim 9, wherein said slip resistant rubber member, covering said rear tubular part, further functioning as a shock resistant deterrent to protect said controller and power assembly.

14. The multi purpose visual and audible signaling baton of claim 9, further comprising:

a removable rear cap having a diameter slightly larger said rear tubular part for snugly mounting to said rear tubular part away from said gasket member; and said removable rear cap being made of a pliable plastic vinyl material for permitting sealing of said rear tubular part of said tubular structure around the receiving slots and said securely mated ear shaped members of said controller circuit board.

15. The multi purpose visual and audible signaling baton of claim 14, wherein the pliability of said removable rear cap receiving said audio voice button positioned between said pair of ear shaped members of said controller circuit board to permit activation of said audio voice button and for rear access into said hollow tubular structure of said baton.

16. The multi purpose visual and audible signaling baton of claim 9, wherein said controller and power assembly further comprising:

a power source for providing power to said controller and power assembly, said power source being mounted to said controller circuit board opposite said controller and power assembly with said controller circuit board positioned there between to compact said controller and power assembly in said rear tubular part.

17. The multi purpose visual and audible signaling baton of claim 9, further comprising:

a front cap having a round tubular shape and being made of a pliable plastic vinyl material, said front tubular cap snugly and securely fitting to said front tubular part of said hollow tubular structure away from said gasket member, and surrounding said bridge bar and piezo whistle and sound fixture exposed in the outer opening, with said front tubular cap providing protection to form light as a beam.

18. The multi purpose visual and audible signaling baton of claim 9, wherein said electrical connecting member further comprising:

a hollow cylindrical pipe for holding a plurality of wires electrically connecting said controller and power assembly to said male electrical plug, said electrical connecting member being guided through said rear tubular part into said front tubular part with said male electrical plug protruding into to said front tubular part, said ear shaped members of said controller circuit board aligning and snugly mating with the slots of said rear tubular member for securing said controller circuit board in said rear tubular part of said baton and positioning said male electrical plug in said front tubular part past said gasket member.

19. The multi purpose visual and audible signaling baton of claim 9, wherein said electrical connecting member further comprising:

a hollow cylindrical pipe for holding a plurality of wires electrically connecting said controller and power assembly to said male electrical plug, said electrical connecting member being guided through said rear tubular part into said front tubular part with said male electrical plug protruding into to said front tubular part, said ear shaped members of said controller circuit board aligning and snugly mating with the slots of said rear tubular member for securing said controller circuit board in said rear tubular part of said baton and positioning said male electrical plug in said front tubular part past said gasket member.

20. The multi purpose visual and audible signaling baton of claim 9, wherein said piezo whistle sound feature receives a digital command signal and vibrates causing air displacement within said semi-hemispherical concave member for generating sound waves that exceed 100 dbA at 10 feet.

* * * * *